United States Patent [19]

Knight et al.

[11] Patent Number: 4,589,576

[45] Date of Patent: May 20, 1986

[54] DISPENSER FOR SOLID FOODS

[75] Inventors: Gerard S. Knight, Plymouth; Perry A. Dreyer, Burnsville; Robert B. Gjelhaug, Brooklyn Center, all of Minn.

[73] Assignee: Waymouth Farms Inc., Plymouth, Minn.

[21] Appl. No.: 523,930

[22] Filed: Aug. 17, 1983

[51] Int. Cl.[4] ..... G01F 11/10

[52] U.S. Cl. ..... 222/357; 222/566; 220/200

[58] Field of Search ..... 222/238, 236, 412, 414, 222/559, 319, 388, 386, 409, 339–341, 362, 361, 566, 567, 572, 564, 475, 356–358, 323, 465 R, 1; 220/200, 85 D, 85 E, 85 R; 128/1 B; 414/403, 404, 416

[56] References Cited

U.S. PATENT DOCUMENTS

| | | | |
|---|---|---|---|
| 2,069,371 | 2/1937 | Klein | 222/356 |
| 2,353,521 | 7/1944 | Steffens | 222/566 |
| 2,550,568 | 4/1951 | Kersh | 222/567 |
| 2,600,240 | 6/1952 | Grieb | 128/1 B |
| 2,608,321 | 8/1952 | Schlambohm | 222/566 |
| 2,670,108 | 2/1954 | Skogstad et al. | 222/567 |
| 2,786,740 | 2/1957 | Taylor et al. | 128/1 B |
| 4,006,850 | 2/1977 | Farina | 222/356 |
| 4,328,904 | 5/1982 | Iverson | 220/200 |

FOREIGN PATENT DOCUMENTS

| | | | |
|---|---|---|---|
| 2257693 | 11/1972 | Fed. Rep. of Germany | 220/200 |

*Primary Examiner*—Joseph J. Rolla
*Assistant Examiner*—Kenneth Noland
*Attorney, Agent, or Firm*—James V. Harmon

[57] ABSTRACT

A dispenser is described for food products stored in buckets or bins usually of cylindrical shape lying on one side. A transparent cover is sealed to the bin, a dispensing spout communicates through the cover and a means such as a plunger or auger extends into the bin through the cover.

6 Claims, 12 Drawing Figures

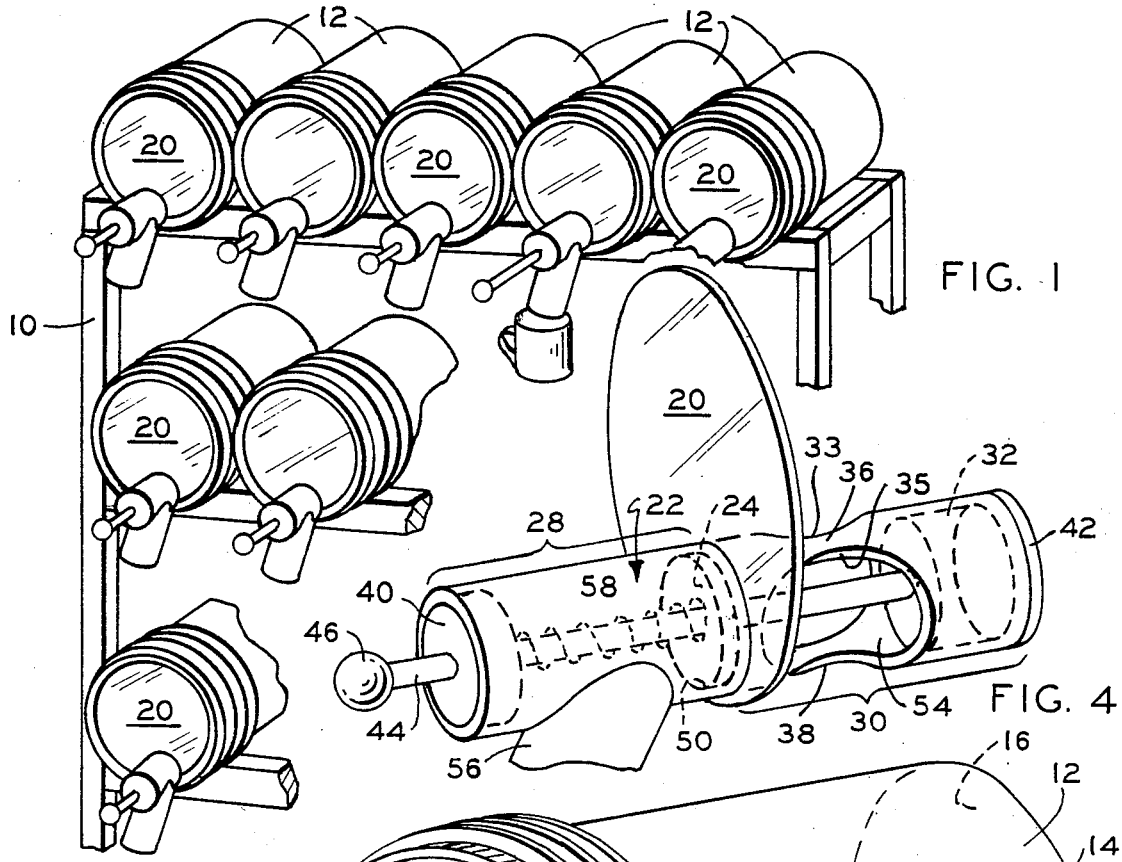
FIG. 1
FIG. 4
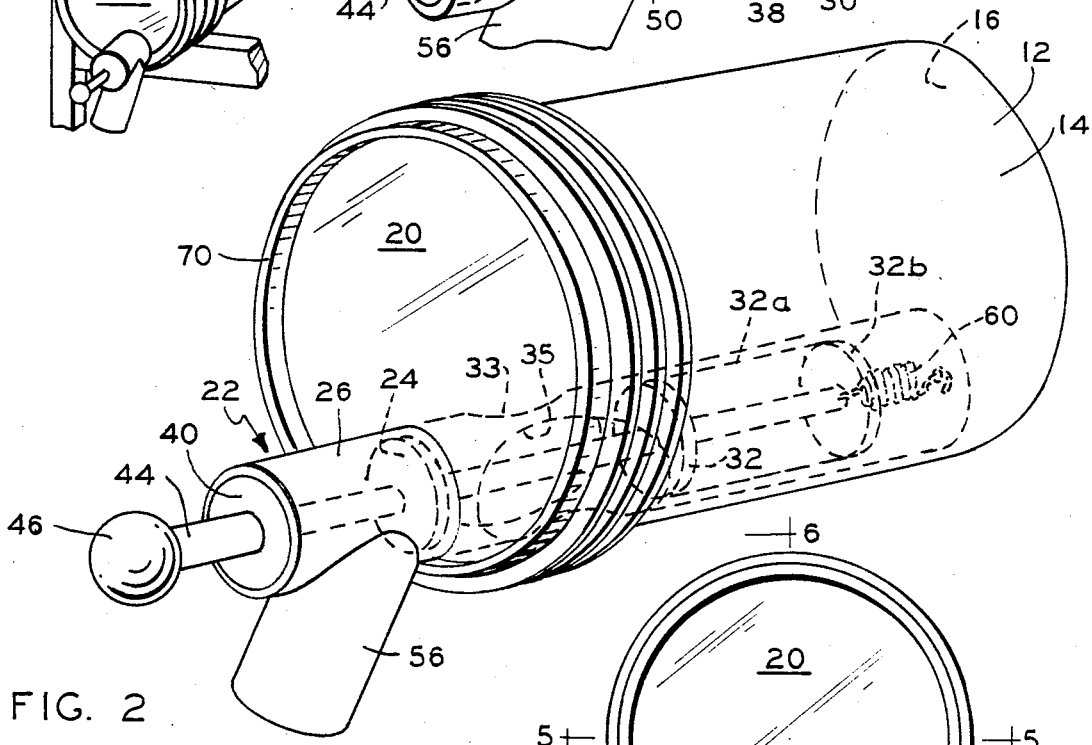
FIG. 2
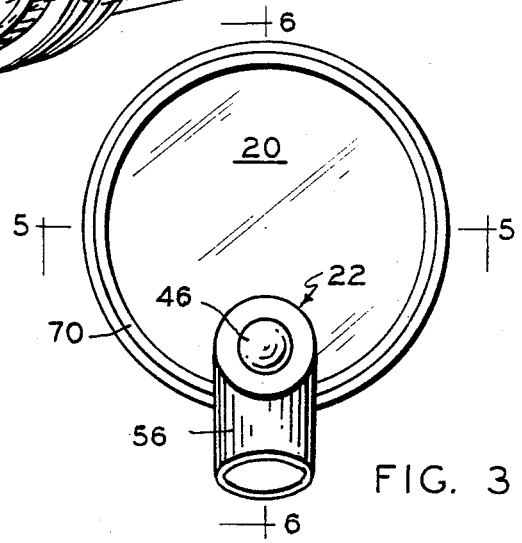
FIG. 3

DISPENSER FOR SOLID FOODS

FIELD OF THE INVENTION

The present invention relates to food storage and dispensing and more particularly to the dispensing of foods in bulk form.

THE PRIOR ART

There has been a rapid growth in recent years in the marketing of certain foods in bulk form. Particularly in cooperative stores, health food stores and in the larger supermarkets where foods are merchandised in boxes, bulk foods such as bulk nuts, dried fruit and powders have become popular. These bulk foods are usually kept in barrels or buckets. The customer reaches in with a scoop or, if a scoop is not handy, he sometimes reaches in with the hand to remove the product. This is unsanitary and foods can be tampered with. As a result, attempts have been made to dispense the foods with an auger or plunger but results have not been satisfactory. It is important that the container be easy to fill and maintain as well as keeping the product in a sanitary condition. Another problem is that the product, particularly when it is sticky as in the case of dried fruit, tends to bridge or stick together so that free flow is prevented. Yet another problem is that a quantity remains in the bucket even when the dispenser is operated vigorously because the dispenser cannot empty the bucket completely. Another problem is spillage either before or after operating the dispenser. Another shortcoming of some prior devices is that only certain products can be handled. They are unsuitable either for finely ground products or for large products which tend to clog the dispensing mechanism. A further shortcoming of certain devices is that they cannot be easily taken apart for refilling or cleaning. The dispenser should also be tamperproof, that is to say, constructed so that the product cannot be touched or reached with the hands. A further shortcoming is that the product cannot be removed easily so that excessive force is needed to operate the dispensing mechanism by hand. Yet another problem is that the dispenser mechanism has no provision for automatically resetting it to begin a new cycle of operation.

In certain of the other dispensers that have been previously proposed, small items can be easily dispensed, but larger products such as peanut clusters, apricots, etc. cannot be readily dispensed since they tend to cling together or jam in the dispensing mechanism. A further problem is that the customer needs to have both hands free to operate the dispenser. Finally, some prior dispensers tend to slice certain products into pieces during the dispensing operation.

Toward the foregoing and related ends, the invention then comprises features hereinafter particularly described in connection with the figures by way of example.

THE FIGURES

FIG. 1 is a perspective view showing several of the dispensing containers in accordance with the invention as they appear on a store rack ready for operation.

FIG. 2 is a perspective view of one of the dispensers on an enlarged scale.

FIG. 3 is a front elevational view of the disenser.

FIG. 4 is a perspective view of the dispenser as it appears when removed from the bucket or other storage container in which it is normally located.

SUMMARY OF THE INVENTION

Figure 5:
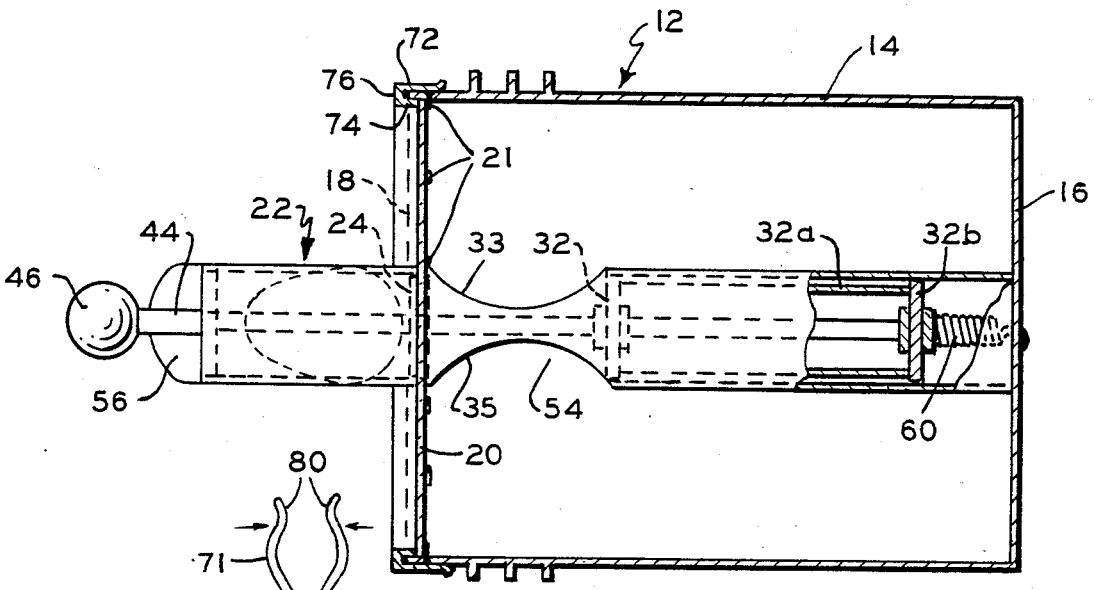
FIG. 5 is a transverse sectional view taken on line 5—5 of FIG. 3.

In accordance with the present invention, a food dispenser is provided especially useful in supermarkets and other stores for measuring and dispensing a variety of food products such as bulk packed nuts, raisins, apricots or other dried foods and various kinds of powdered food materials. The food is stored in a sealed bucket or bin that is laid on its side with its longitudinal axis in a substantially horizontal position. The bucket is open at one end and the open end is sealed with a transparent closure plate. Fixed rigidly to the closure plate is a dispenser comprising a cylinder having a movable food displacing unit therein. The cylinder has inlet openings at least in its side walls to permit entry of the food from the bucket to the dispensing cylinder. An operating handle extends longitudinally of the dispensing cylinder and extends through the end thereof with a hand grip enabling the user to move the dispensing element so as to propel food from the inside of the bucket through the cylinder toward the closure plate. A portion of the cylinder extends outwardly beyond the end of the closure plate and a dispenser outlet spout is secured to the cylinder. When the operating handle is moved so as to activate the dispensing element within the cylinder, the food product is moved from within the bucket to the cylinder and falls out through the spout. The dispensing element can comprise either a flighted auger adapted to be rotated and thereby propel the food to the outlet nozzle or, if desired, a plunger having a compartment for transferring food from the inlet openings to an area adjacent to the outlet spout by sliding the plunger longitudinally through the dispensing cylinder. In another form of the invention, a flexible bag or glove is secured in the wall of the closure plate, an outlet spout is positioned in the closure plate adjacent to the bag so that the customer, by placing his hand in the bag, can grasp the product or a scoop and thereby scoop the product into the outlet spout.

The invention will now be described by way of example with reference to the figures.

DETAILED DESCRIPTION OF THE INVENTION

Refer now to FIGS. 1–5. FIG. 1 shows a storage rack 10 that can be built up from metal or wood to hold a plurality of buckets 12 on their sides so that the longitudinal axis of each bucket is in a substantially horizontally position. The buckets have a side wall 14, bottom wall 16 and an open mouth 18 that is sealed when the buckets are in use by means of a circular top closure plate 20 that is rigidly secured to the cylindrical dispenser body 22 which in this instance comprises a hollow cylinder formed from plastic resin or the like. By reference to FIGS. 4 and 2, it can be seen that the dispenser 22 is rigidly secured to the closure plate 20 along circular line 24. This connection can be formed by means of adhesive or parts if injection molded can be molded together so that the closure plate 20 and cylinder 22 are integral with one another. Other means of connecting plate 20 and cylinder 22 will be described. Stops 21 in the bucket mouth limit inward movement of plate 21. Means for securely fastening these parts will be described below.

The dispensing cylinder 22 as best seen in FIG. 2 lies along the inside surface of side wall 14 of the bin or bucket 12 so that its outer surface is in contact with the inner wall of the bucket. The dispenser includes a cylindrical side wall 26 having an external portion 28 and in internal portion 30, the latter of which includes two laterally opening inlet ports or openings 33 and 35 that are bilaterally aligned and located within the bucket 12. Each of the openings 33 and 35 are generally oval in configuration, the longitudinal axis of the oval opening being substantially greater than the vertical axis. In this way, two laterally aligned side-by-side, oval or eliptical, openings are provided each extending along the cylinder a distance which is somewhat greater than the height of the opening. The top and bottom of the two openings 33 and 35 approach one another to define a pair of connecting ligaments 36 and 38 in the wall of the dispensing cylinder 22. The dispensing cylinder 22 includes end walls 40 and 42, the former of which is provided with an opening for an operating handle 44 with a knob 46 at the end. The end wall 40 is screw threaded into the end of the cylinder 22. Connected rigidly to the handle 44 is a pair of longitudinally spaced apart circular plates 50 and 52 which define between them a dispensing compartment 54. A coil spring 58 is positioned between the plate 50 and the end wall 40 to return the plunger to its starting position as shown in FIG. 4. To the external portion 28 of the cylinder 22 is connected a downwardly extending inclined outlet spout 56 through which product is dispensed when the plunger is moved longitudinally through the cylinder 22. It can be seen that the operating handle 44 and the circular plates 50, 52 define a movable dispensing element or plunger within the cylinder 22. Each time the plunger is moved from the position shown in FIG. 4 to the dispensing position wherein the compartment 54 is aligned over the nozzle 56, a quantity of food is dispensed from the bucket 12.

Refer now to FIGS. 2, 3, 5 and 6 which illustrate a slightly different form of dispenser.

FIGS. 2, 3, 5 and 6 show that a dispensing cylinder 22 like that already described, but the internal movable dispensing element is somewhat different as will now be described. The handle 44 has connected to it a pair of longitudinally spaced apart dispensing plates 24 and 32 which define between them the dispensing chamber 54. Extending longitudinally toward the bottom end of the bucket from the plate 32 is a cylinder **32*a*, the opposite end of which is connected to a second circular plate 32*b* that is rigidly affixed to the handle 44. It will be seen best by reference to FIGS. 5 and 6 that the cylinder 32*a* is slightly smaller in diameter than the diameter of the plate 32 and 32*b*. In this way, the cylinder 32 is spaced from the wall of the dispensing cylinder 22. One end of cylinder 22 abuts against the bottom wall 16 of the bucket 12. The peripheral edge of each of the circular plates 32 and 32*b* is of just the proper size to fit easily and slide smoothly within the cylinder 22. In this way, the plates 32, 32*b* will scrape and remove from the inside surface of the cylinder food tending to cling to it. The plunger defined by the handle 44 and the plates 24, 32 and 32*b* can therefore be thought of as self-cleaning within the cylinder 22. The spring 58 is not used. In its place, a tension spring 60 is provided between the end of the plunger and the bottom wall 16 of the bucket. This will draw the plunger back into the bucket after the knob 46 is released thereby returning the dispensing element or plunger to its retracted position as shown in FIG. 5. When the knob 46 is pulled toward the left in FIG. 5, the food which has entered the cylinder 22 through the inlet openings 33 and 35 will be transferred toward the left in the figure to the spout 56** through which it is dispensed.

Figure 6:
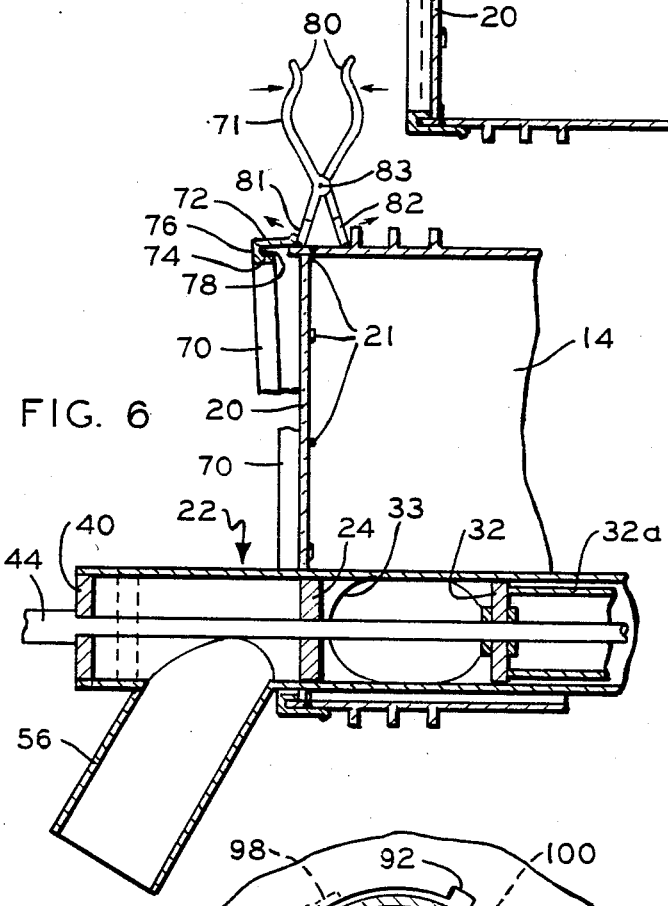
FIG. 6 is an enlarged cross-sectional view taken on line 6—6 of FIG. 5.

Refer now to FIG. 6 which illustrates the manner in which the end closure plate 20 is held in position. To securely retain the end closure plate 20 in place on the end of the bucket 12, a semiflexible retaining ring is provided having a pair of spaced apart external and internal annular walls 72 and 74 connected by circular center portion 76 to define a circular groove 78 of just the proper size to fit over the mouth of the bucket 12. The semiflexible retaining ring 70 is of the proper size to form a tight compression fit, i.e., interference fit, over the end of the bucket. To secure the closure plate 20 and dispenser in bucket 12, the closure plate 20 is placed in the position in FIG. 5 and the sealing ring 70 which is shown loose at the top in FIG. 6 is forced onto the end of the bucket, for example, by hammering it in place. The tight compression fit of the sealing ring around the mouth of the bucket 12 prevents manual removal. The best way the ring 70 can be removed is by means of a tool 71 in the nature of a reverse pliers constructed so that by squeezing on the handles 80, the jaws 81 and 82 pivoting about a center pivot 83 when placed between portions of the bucket and the ring 70 will function to pry the ring off the end of the bucket. The sealing ring 70 cannot be removed with the hands because of its interference fit on the rim of bucket 12. In this way, an extremely secure, reliable, tamperproof and theftproof means is provided for holding the dispenser and closure wall in place on the bucket 12. Consequently, the bulk contents of the bucket is kept secure and sanitary between fillings.

Figure 7:
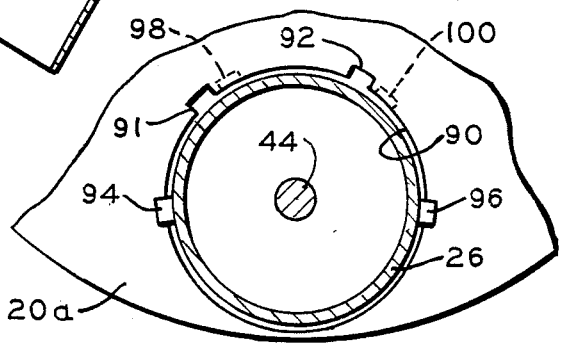
FIG. 7 is a partial vertical sectional view of a modified form of dispenser.
Figure 8:
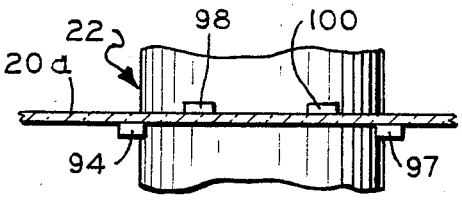
FIG. 8 is a top view of the dispenser of FIG. 7.

Refer now to FIGS. 7 and 8 which illustrate a modified form of the invention.

As shown in FIGS. 7 and 8, the dispensing cylinder 22 is releasably mounted in an aperture 90 within the closure plate 20. As best seen in FIG. 7, the aperture 90 is circular and is located in the lower portion of the plate 20 adjacent its lower edge **20*a*. The aperture 90 is provided with circumferentially distributed slots 91 and 92. The tube 22 is provided with circumferentially distributed lugs 94 and 96 adapted to be positioned on the outside surface of the plate 20. Another set of lugs 98, 100 are distributed circumferentially with respect to one another and axially with respect to the lugs 94 and 96. The spacing between 98 and 100 is the same as between slots 91, 92 so that the lugs 98, 100 can be passed through the slots by pressing inwardly on the dispensing tube 22. The tube 22 is then rotated about its center axis thereby causing the lugs 98, 100 to be shifted circumferentially with respect to the slots 91, 92. In this way the dispensing cylinder 22 is releasably and removably retained within the aperture 90 of the closure plate 22. As a result, it can be easily and quickly removed for cleaning or replacement as required. If desired, the bucket 22 can be filled through the aperture 90. The embodiment in FIGS. 7 and 8 has the advantage of allowing the dispenser cylinder 22 to be more easily removed but the lugs and slots make the design somewhat more complex. The embodiments of FIGS. 1–6** have the advantage of better security and improved ability to keep the product sanitary.

Figure 9:
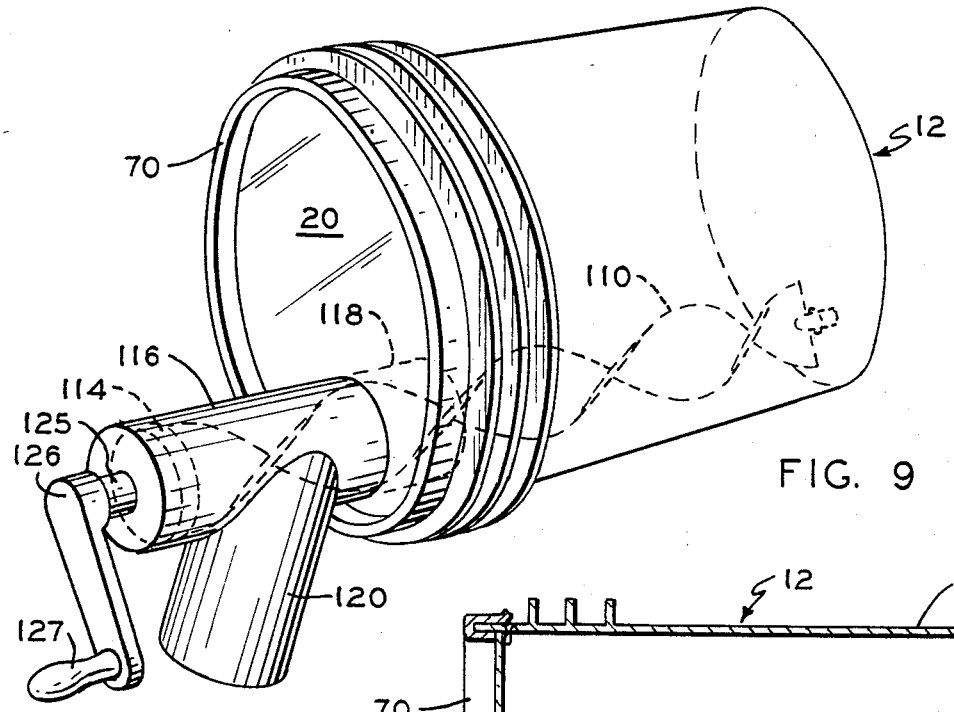
FIG. 9 is a perspective view of another form of dispenser.
Figure 10:
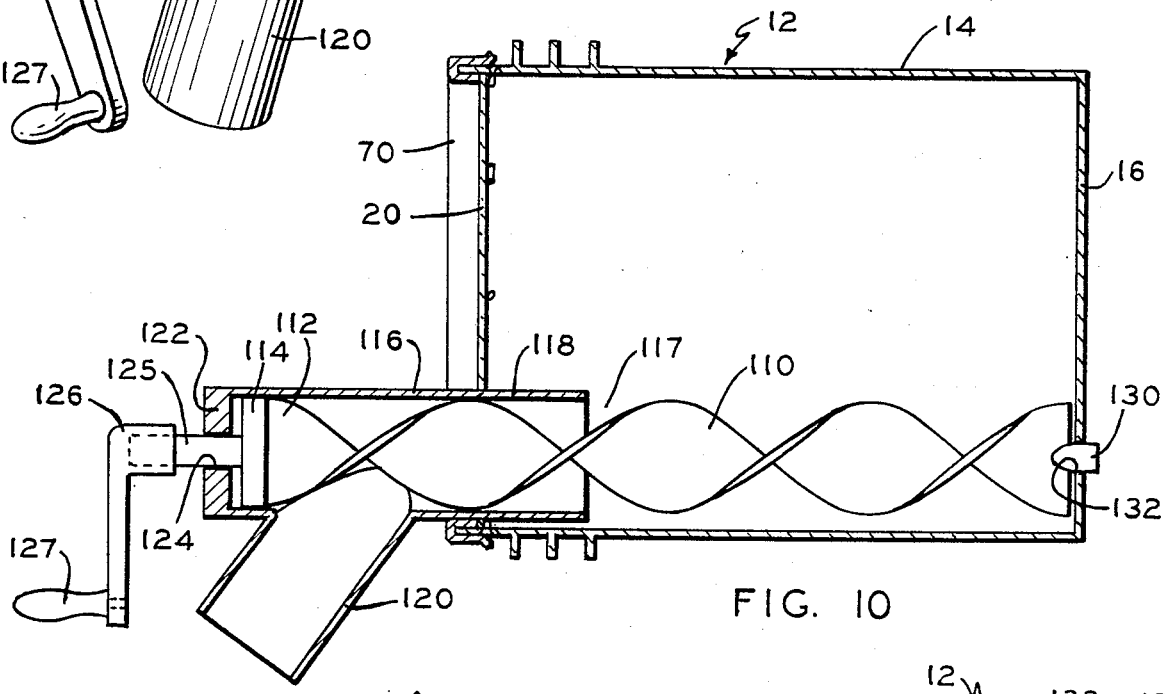
FIG. 10 is a vertical cross-sectional view of the dispenser of FIG. 9.

Refer now to FIGS. 9 and 10 which illustrate another embodiment of the invention wherein the same numerals refer to corresponding parts already described in different views.

Shown in FIGS. 9 and 10 is an auger type dispenser including an auger 110 composed of a flat strip of rigid material such as metal or plastic having a twisted or corkscrewlike configuration. In this case the auger consists of a flat strip of material twisted longitudinally so that its outer edge makes two complete turns. Rigidly secured to the front end 112 of the auger is a circular front plate 114 adapted to fit within an auger cylinder 116*a*. It will be seen that a portion 118 of the cylinder extends inwardly from the plate 20. Tube portion 118 has been found important to prevent product from flowing or leaking out inadvertently when no product is intended to be dispensed. The dispensing cylinder 112 is provided with an outlet spout 120 connected at its upper end to the external portion of the dispensing cylinder 116*a*. The spout 120 extends downwardly at an inclined angle projecting in a direction away from the container 12. At the free end of the dispensing cylinder 116 is provided a closure plate 122 having an opening 124 through which a center shaft 125 extends. Mounted on the center shaft 125 is a crank 126 having a handle 117 with which an auger 129 can be turned manually. At the rear end of the auger is an axle shaft 130 adapted to support the inner end of the auger within an opening 132 in the rear wall 16 of the bucket 12. During operation, as the handle 127 is turned rotating shaft 125 and the auger 112, the product contained within the bucket 12 will pass into the opening 117. Further rotation of the auger will cause the product to be introduced into the section 118 of the dispensing cylinder 116*a*. Thus the rotation of the auger 112 will advance the product through the plate 20 into the portion 116*a* of the dispenser above the outlet spout 120 whereupon the product will fall into a cup, bag or other receptacle that is held in place beneath the spout 120 by the customer.

Figure 11:
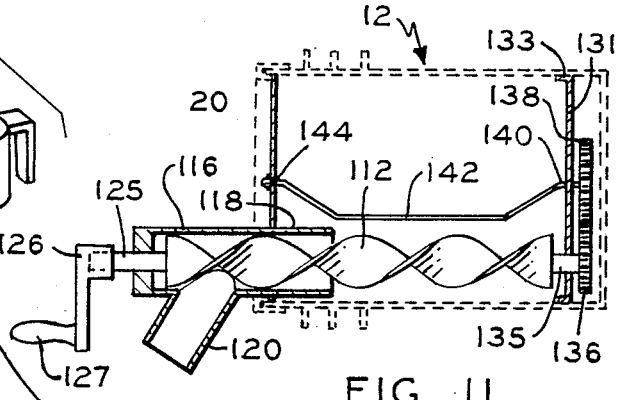
FIG. 11 is another form of dispenser having an agitator for stirring up the product during the dispensing operation and FIG. 12 is yet another form of dispenser.

Refer now to FIG. 11 which shows another embodiment of the invention. This embodiment is similar to the embodiment described in FIGS. 9 and 10 and the same numerals refer to corresponding parts except as will be described below. At the right or inner end of the auger 112, the bucket 12 has mounted within it a false bottom composed of a flat circular plate 131 having a circular edge flange 133 frictionally engaged within the inner wall of the bucket 12. The auger 112 has a center shaft 135 extending to the right from its inner end to which is secured a gear 136 engaged with a second gear 138 above it. Gear 138 is, in turn, mounted on the end of a wire agitator 140 having a central portion 142 displaced somewhat from the center axis of wire 140 and gear 138. As can be seen, a portion of the agitator 140 adjacent to gear 138 extends through an opening in the false end wall 131 while the opposite end is mounted for rotation at 144 within the cover plate 20. During operation, by turning the handle 127 and rotating auger 112, the gear 136 is rotated thereby turning gear 138 and causing the agitator wire 142 to rotate within a circular arc above the auger 112. As a result, the product located within the bucket 12 above the auger 112 will be moved slowly as the auger 112 turns thereby preventing the product in case it is sticky or becomes bonded together from bridging over above the auger 112. The product within the bucket can thereby be reliably removed even though it has a natural tendency to stick to itself within the bucket.

Figure 12:
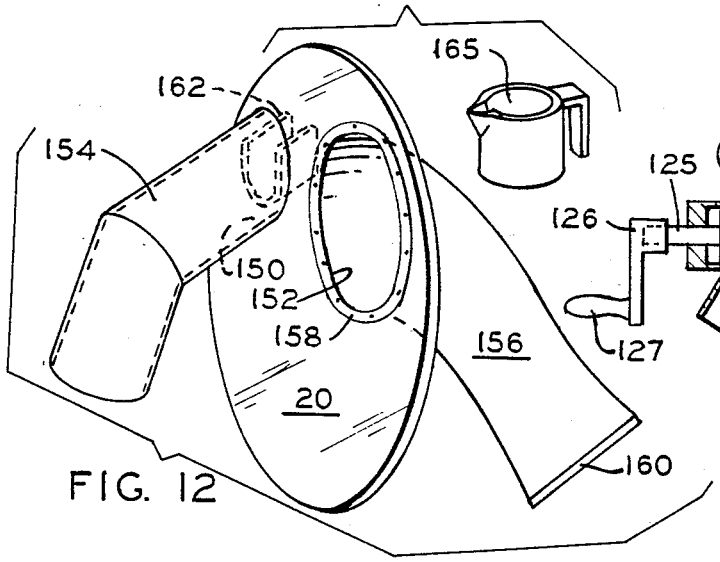

Refer now to FIG. 12 which illustrates yet another embodiment of the invention. In FIG. 12, closure plate 20 which as described above consists of a disc of transparent material such as a rigid transparent plastic sheet of circular shape is provided with openings 150 and 152, the former to accommodate a dispensing cylinder or spout 154 and the latter, which serves as a hand hole, to accommodate a flexible tube 156 having a connected end sealed at 158 to the hand hole and a free end 160 which is closed and sealed to itself. The inner end 160 depends downwardly within the bucket 12 and can be moved manually into proximity with spout 154. The spout 154 is provided with a short trough-shaped inlet section 162 and projects inwardly or centrally from the closure plate 20. Within the bucket a scoop can be provided if desired. In FIG. 12 a scoop 165 of approximately one-cup capacity is shown by way of example. The tube 156 can consist of any suitable membranous material such as rubber or plastic and because it is fastened securely as its outer edge around the periphery of the opening 158 and is closed by hermetic seal 160 at its innermost free and, the flexible tube 156 provides a hermetic seal for the bucket thereby reliably preventing the introduction of foreign material and in this way keeping the contents of the bucket in a sanitary condition. Another excellent tube is a nitrile rubber glove or mitt of approximately 10 mil thickness. In the figure is shown a polyethylene tube of 4 mils thickness. The spout 154 is sized, constructed and arranged, e.g., by having a bend therein to prevent a hand from being inserted through it into the bucket. When the embodiment of FIG. 12 is to be used, the customer places one hand in the hermetically sealed tube 156 and grasps the product with the hand or, if desired, the scoop 165 which is kept within the bucket. The product or scoop is grasped with the flexible membrane of the tube 156 covering the hand. The product in the bucket is then scooped up and poured into the inlet trough section 162 adjacent the outlet opening 150 of the plate 20. The product then falls through the tube 154 and flows out into a paper bag or other receptacle held beneath it. The trough 162 while helpful in some cases is not essential and can be omitted if desired. The embodiment of the invention shown in FIG. 12 provides several important beneficial results. It occupies a very small space and is therefore more easily packaged and shipped than the forms shown in FIGS. 1–11. In addition, it is easier to refill and clean. No precision parts are required thereby lowering production costs. The form of the invention shown in FIG. 12 is also less expensive to produce since it contains fewer parts than those already described but may not be considered as sanitary or tamperproof since the tube 156 will eventually wear out requiring repair or replacement. However, excellent results can be obtained if the tubes 156 are replaced during routine maintenance at pre-established intervals.

The invention can be constructed from a variety of materials. A rigid plastic resin has been found satisfactory for most parts. For example, the dispensing cylinders 22 and 116*a* can be formed from three-inch diameter plexiglass tubing. The dispensing spouts 56 and 120 and 154 can be formed from similar materials. The handle 44 can be formed from a one-half inch diameter rod of plexiglass. Other parts can be made from a variety of metals or plastics which will be apparent to those skilled in the art once the principles of the invention are understood.

It can be seen that the invention provides a highly secure tamperproof storage and dispensing system for a variety of products and is particularly well adapted for food products. The interference or pressure fit of the sealing ring 70 around the mouth of the bucket 12 has been found especially effective in preventing the closure plate 20 from being removed. Moreover, it can be seen that because the dispensing cylinder 22 is mounted within the closure plate 20 any suitable type of storage bucket or barrel can be employed. The bucket or barrel 12 need not even have a circular cross-section. It could, for example, be rectangular in configuration with the dispensing cylinder 22 mounted to extend longitudinally within one of the corners.

It was also found that the invention promotes a constant flow of product without bridging whether a plunger is used for dispensing the product or an auger is used. In severe cases of bridging, the agitator 140 is highly effective in breaking up the product in the area just above the auger 112.

It was also found that the product in the bucket is available for dispensing even when little is left to be removed. In other words, the invention has been found effective in removing the last remaining portions of the product from the container. There is little or any spillage of the product after the dispenser is operated. Furthermore, the apparatus can be employed with a variety of products and can be taken apart easily for refilling and/or cleaning. It can also be seen that the removable dispensing member within the apparatus effectively prevents one from introducing hands through the dispensing cylinder into the product contained in the bin or bucket. This again helps to keep the product from being tampered with. By operating the moving element within the dispensing cylinder, the product can be easily removed with very little physical effort. Moreover, in the embodiments of FIGS. 1–6, the spring connected with the plunger reliably draws the plunger back automatically to the starting position in which the dispensing plunger is ready to dispense more product.

While there has been in the past a problem of dispensing some larger products particularly relatively large food products such as peanut clusters and apricots, the present invention is highly effective in storing and dispensing such products without excessive breakage. Moreover, the customer does not need two hands to operate the dispenser. It was also found that products which tend to break or cut in half are seldom sliced into pieces when dispensed with the present invention.

The invention has been found suitable for a variety of food products such as nuts, granola, seeds, mixes, pasta, rock candies, raisins and other dried fruit and the like.

The operation of the invention is obvious to supermarket customers. After being placed in a rack and the buckets filled with the product, a customer using a bag of any suitable size simply places the bag around the spout 56, 120 or 154, operates the handle as much as necessary or, in the case of the plunger design, pulls the handle out longitudinally as many times as required for the amount of product desired. An advantage of the plunger design described in FIGS. 1–6 is that the sliding action of the plunger is simple, smooth and easy to accomplish. In addition, a predetermined volume is dispensed with each stroke of the plunger. All embodiments, however, can be considered spillproof and easily cleaned. Moreover, all of the embodiments can be used with standard commercially available buckets or barrels without modification as, for example, cutting a hole in one wall.

Many variations of the invention will be apparent to those skilled in the art within the scope of the appended claims once the principles of the invention are understood.

What is claimed is:

1. A food storage and dispensing container for food products including nuts, granola, dried fruit and the like, said dispensing container comprising (a) a container body having a bottom wall and side walls terminating in an open wide mouth and being adapted to be used with the mouth to one side such that the side walls and central axis of the container are oriented other than in a vertical position, (b) a removable cover plate formed from a sheet of rigid transparent material extending across and sealing the open wide mouth of the container and adapted to be withdrawn for refilling the container with the food product, (c) said removable cover plate having first and second side-by-side spaced apart openings therein;

(d) a dispenser spout depending downwardly during use on the outside of the cover plate, the spout being connected to the cover plate around the edge of the first opening and communicating therethrough with the interior of the container for conveying the food product out of the container, (e) said second opening in the cover plate comprising a hand hole, (f) a flexible tube sealed at its outer edge around the edge of the hand hole and extending into the container from the hand hole, (g) said flexible tube having a free end within the container and the free end of the tube being closed, (h) the spacing between the first and second openings being within the reach of a hand placed into the flexible tube whereby a person's hand can be placed in the tube to grasp the product in the container and the flexible tube moved manually to a position in proximity with the dispensing spout to permit manual dispensing of a food product from the container to the spout, (i) the spout and tube being removed simultaneously from the container when the cover is removed and, (j) said spout terminating in an outlet nozzel at its free end through which the product is dispensed from the container.

2. The container of claim 1 wherein said spout is oriented on the outside of the cover such so that when the container is placed during use other than in the vertical position with the cover other than horizontal, the spout will depend therefrom with said nozzel opening downwardly whereby food products dispensed manually from the container will fall through the spout and pass out through the nozzle.

3. The container of claim 1 wherein a security fastener means is operatively connected to the cover for securing the cover to the open mouth of the container to prevent unauthorized removal of the cover and thereby preserve the sanitary condition of the food product in the container.

4. The dispensing container of claim 1 wherein said spout is sized, constructed and arranged to prevent a hand from being inserted through it from the outside into the container to aid in maintaining the food product in a sanitary condition.

5. A method of dispensing food products from a storage container having a bottom wall, side walls terminating in an open wide mouth with a removable cover plate formed from rigid transparent sheet material extending across the open wide mouth and including a pair of side-by-side openings one of which is sealed by means of a closed flexible tube secured to its edge, the other opening being provided with a dispensing spout on the outside of the cover and the dispensing spout being within reach of a hand placed in the flexible tube, said method comprising, placing a hand in the hermetically sealed tube, holding a receptacle with the other hand, grasping a product in the container manually with the flexible tube between the product and the hand, moving the product toward the dispensing spout, passing the product through the opening connected to the spout and, allowing the product to fall through the spout into a receptacle held beneath the spout with the other hand.

6. The method of claim 5 wherein the spout is sized, constructed and arranged to prevent a hand from being inserted through it from the outside into the container whereby product within the container can be dispensed through the spout but a hand cannot be introduced into the container through the spout from the outside.

* * * * *